US008147391B1

(12) United States Patent
Hill

(10) Patent No.: US 8,147,391 B1
(45) Date of Patent: Apr. 3, 2012

(54) EXERCISE BAR

(76) Inventor: Donald R. Hill, Anchorage, AK (US)

( * ) Notice: Subject to any disclaimer, the term of this patent is extended or adjusted under 35 U.S.C. 154(b) by 0 days.

(21) Appl. No.: 12/924,490

(22) Filed: Sep. 27, 2010

(51) Int. Cl.
*A63B 71/00* (2006.01)

(52) U.S. Cl. ..... 482/141; 482/132; 482/139

(58) Field of Classification Search ..... 482/91, 482/105–109, 121–126, 129–139, 141–142, 482/145, 908, 909; 601/135–138
See application file for complete search history.

(56) References Cited

U.S. PATENT DOCUMENTS

| | | | | | |
|---|---|---|---|---|---|
| 2,168,975 | A * | 8/1939 | Clarke | 601/138 |
| 3,370,850 | A * | 2/1968 | Moore | 482/105 |
| D262,815 | S * | 1/1982 | Lambert et al. | D21/694 |
| 4,493,315 | A * | 1/1985 | Iwahashi | 601/135 |
| 4,832,334 | A * | 5/1989 | Mullen | 482/106 |
| 4,852,873 | A * | 8/1989 | O'Donnell et al. | 482/126 |
| 4,858,917 | A * | 8/1989 | Montgomery | 482/106 |
| 5,730,708 | A * | 3/1998 | Spratt | 601/118 |
| 5,873,311 | A * | 2/1999 | Schlattl | 108/44 |
| 5,899,837 | A * | 5/1999 | Chen | 482/126 |
| 5,935,090 | A * | 8/1999 | Kennon | 601/134 |
| 6,386,988 | B1 * | 5/2002 | Shearer et al. | 473/220 |
| 6,752,747 | B2 * | 6/2004 | Yu | 482/110 |
| 6,945,918 | B1 * | 9/2005 | Hill | 482/106 |
| 6,988,997 | B2 * | 1/2006 | Stultz | 601/135 |
| 7,056,268 | B2 * | 6/2006 | Emick | 482/106 |
| 7,867,102 | B2 * | 1/2011 | Wallace | 473/220 |
| 7,892,158 | B2 * | 2/2011 | Varga | 482/141 |
| 2005/0227835 | A1 * | 10/2005 | Hazan | 482/140 |
| 2006/0135323 | A1 * | 6/2006 | Sjobakk et al. | 482/92 |
| 2007/0093366 | A1 * | 4/2007 | Zuckerman | 482/121 |
| 2007/0184950 | A1 * | 8/2007 | Bradley | 482/141 |
| 2010/0255967 | A1 * | 10/2010 | Richardson | 482/139 |

* cited by examiner

*Primary Examiner* — Loan Thanh
*Assistant Examiner* — Daniel Roland
(74) *Attorney, Agent, or Firm* — Michael J. Tavella

(57) ABSTRACT

An exercise bar for motocross muscle development. One embodiment has a bar and a special rocker member for use on floor exercises. A second embodiment has a spring-loaded pivot hub. That embodiment also has folding handgrips that make the device easy to story and carry. Both embodiments have handgrip eyes that can support the ends of the bar for a number of different exercises. Both embodiments have an eye that can support the handlebar as well. A sliding hook can be used to can carry weights and can act as a support when the device is used on a floor. The rocker member is an important feature that allows a user to do intensive push-up type exercises using the bar.

3 Claims, 15 Drawing Sheets

EXERCISE BAR

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to exercise bars and particularly to exercise bars for training that are multifunctional.

2. Description of the Prior Art

The sport of motocross cycling (either on motorcycles or bicycles) and other sports involving vehicles such as snowmobiles and personal watercraft have been enjoyed for years by thousands of people. These activities, however, are athletic in nature and, as such, require proper conditioning to perform at optimum levels. At the competitive levels, these sports require excellent physical conditioning to be able to participate with any kind of competence. Areas of conditioning include the hands, arms, the chest, back and shoulders. Since these vehicles are steered using handlebars, hand, arm, the chest, back and shoulder strength and flexibility are essential.

There are exercises that can develop the hands, arms, the chest, back and shoulders. These exercises can be done on exercise equipment such as a multi-function gym machine, which has weight bars that can be attached to cables that can be weighted down further. Weights are attached to the machine and the bars are gripped by the user to pull the weights in a particular direction and with particular arm spacing. In this way, different muscle groups can be worked.

To meet this need, I developed an exercise bar that be attached to any multifunction gym, rower or resistance band device. This bar is now the subject of U.S. Pat. No. 6,945,918.

That device is an exercise bar shaped like a motocross handlebar. In that design, the user grips the bar as he/she would grip a regular motocross handlebar. Thus, when working out, the user works those muscles in the hands and arms that normally are used in motocross riding. That invention has two ends that are formed to simulate a true handlebar, with grips that simulate a true handlebar. A support bar is added to the top portion of the bar for added stiffness and to provide support for a retractable shaft for pulling exercises. A telescoping hook is also provided at the bottom to support a dumbbell that can be suspended at the bottom of the bar. The top support bar also has an opening to allow a clip from an exercise machine cable to be attached. In this way, the bar can be attached to the machine and the user can use the bar in various exercises with the machine. The advantage, of course, is that with the invention, the user gets the maximum benefit from the workout for motocross riding.

BRIEF DESCRIPTION OF THE INVENTION

The instant invention has two main embodiments. It is an exercise bar that is shaped like a motocross style handlebar. In one embodiment, a self-locking, spring-loaded pivot hub that carries a new hook is used to allow the handlebars to pivot. The pivot hub is spring loaded for ease of use and extra security. This pivot feature allows the device to be used in different ways.

The bar can be fitted with folding handgrips that make the device easy to story and carry. The handgrips have receivers to receive inserts that can be used to support the bar from the ends for a number of different exercises.

In the preferred embodiment, the pivot hub is replaced by a clamp that secures the hook system to the handlebar. It also has an eye that can support the handlebar. Both embodiments also have a special rocker body that is attached to the bottom of the center hook. The rocker member gives more motion while doing the push ups. This rocker body is a major innovation in the use of exercise bars. Finally, a padded cover fits over the mechanical connections to protect the user during use.

DETAILED DESCRIPTION OF THE INVENTION

Figure 1:
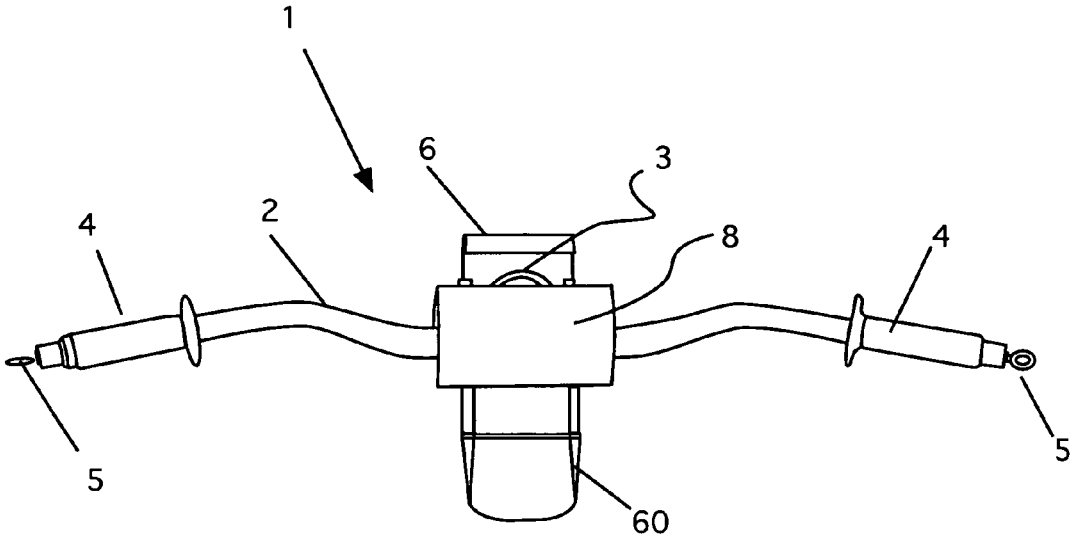
FIG. 1 is a front, top, perspective view of the preferred embodiment of the invention.

Referring now to FIG. 1, a perspective view of the preferred embodiment is shown. The invention 1 has a handlebar portion 2 that uses a 1⅛" inch tapered bar to form the handlebar portion. Because the bar is shaped like a motocross style handlebar, the user is able to position his or her body and arms in similar positions to those experienced in actual motocross riding, which ensures that the user works the exact muscles needed in riding. Of course, other exercises can be done with the bar to develop overall fitness, which is also needed for proper motocross riding.

The device has a 3/16" diameter center eye 3. The device also has handgrips 4 at each end, as shown. Each of the handgrips has an attachment ring 5 to expand the possible uses of the device. In the preferred embodiment, these rings are stainless steel. The device also includes a removable push-up/pull-up skid plate 6 that is fitted with a rocker member 60, as discussed below, to increase the range of exercises available. Finally, a padded cover 8 is included to protect users from the metal components during use.

Figure 2:
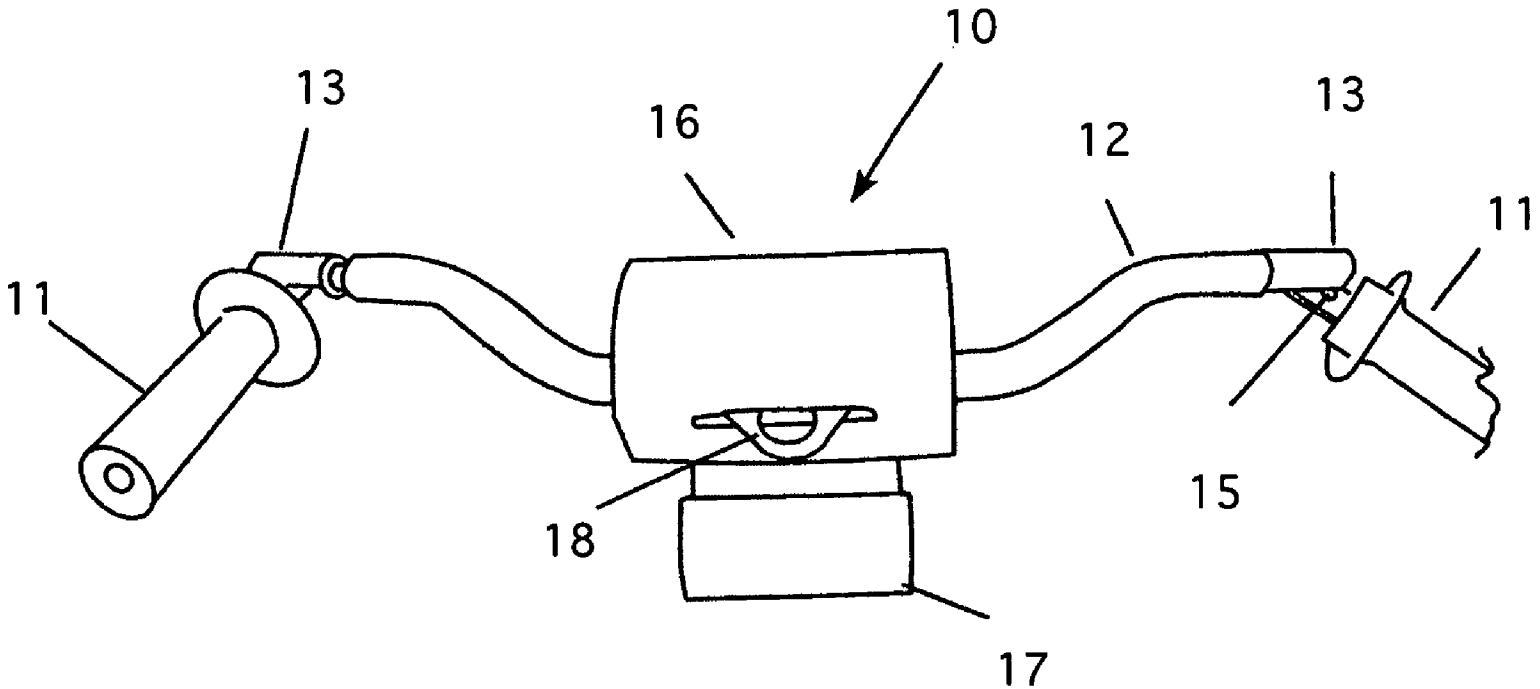
FIG. 2 is a front, top, perspective view of a second embodiment of the invention showing the handgrips in a partially folded position.

FIG. 2 is a front perspective view of a second embodiment 10 of the invention. This embodiment has folding handgrips that make is more suitable for travel. It also has a pivoting handlebar that rotates from a first position to a second position. Although it makes the device somewhat more versatile, the extra features also make the device more expensive to manufacture. For this reason, it is not the preferred embodiment. FIG. 2 shows the device 10 with the handgrips 11 in a partially folded position is shown. As before, the exercise bar is shaped like a handlebar. At the ends of the handlebar 12, are two pivots 13. These pivots are formed on the ends of the handlebar and the two handgrips 11. Pivot pins 15 allow the handgrips to rotate as shown. In FIG. 2, the handgrips are not fully rotated into the storage position. They are normally folded back against the handlebar portion 12. When opened, the pivot point lock to secure the handgrips in place.

In the center of the handlebar 12 is the pivot hub 40. In this figure, it is concealed by the cover 16. However, the sliding hook 17 and the attachment eye 18 are shown.

Figure 3:
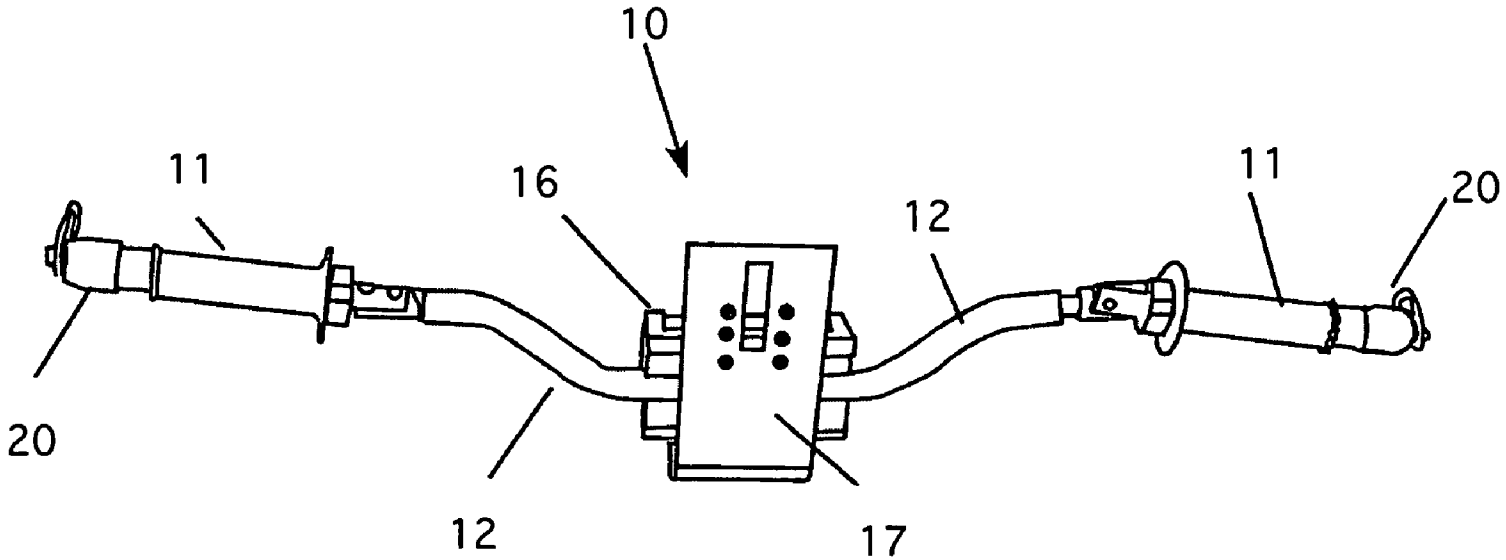
FIG. 3 is a rear, bottom perspective view of the second embodiment of invention with the handgrips in the extended position.

FIG. 3 is a rear perspective view of the invention with the handgrips in the extended position. In this figure, the back side of the second embodiment 10 is shown. The handlebar 12 is shown with the handgrips 11 are rotated into their "in use" positions. FIG. 3 also shows the inserts 20 that are placed in the ends of the handgrips as shown. These inserts are discussed below. At the center of the handlebar, the bottom of the hook 17 is shown. As discussed below, the hook 17 can slide back for storage or for close use, or can be extended to hold larger weights or for floor exercises (discussed below). In this view, the bottom of the cover 16 is also shown.

Figure 4:
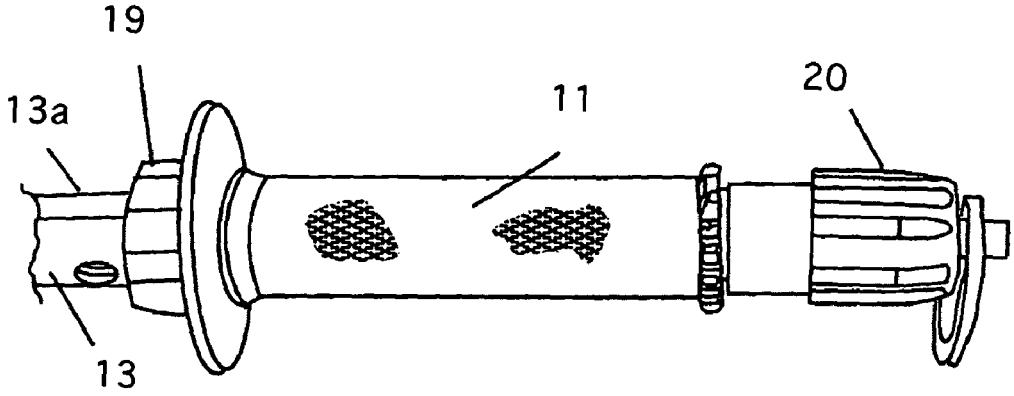
FIG. 4 is a detail view of one of the handgrips.

FIG. 4 is a detail view of one of the handgrips that can be used with either embodiment, although the simple handgrip of FIG. 1 is preferred. Here a side view of the handgrip 11 is shown. The handgrip has a pivot member 13 that meshes with the pivot member 13*a* on the handlebar. A twist lock 19 is rotatably attached to the end of the handgrip. When the pivot members 13 and 13*a* are aligned, the twist lock 19 is rotated out until the pivot members 13 and 13*a* are locked together. To fold the handgrips, the twist lock is reversed until the pivot members are free. Of course, other types of locking devises may be used as well. At the other end of the handgrip is an insert 20. The insert is optional and can be omitted. However, as discussed below, it provides an eye that is used to attach cables, resistance bands, or other exercise devices to expand the uses of the device. When in use, the insert 20 is locked into the end of the handgrip 11. As noted above, it can be removed, if desired.

Figure 5:
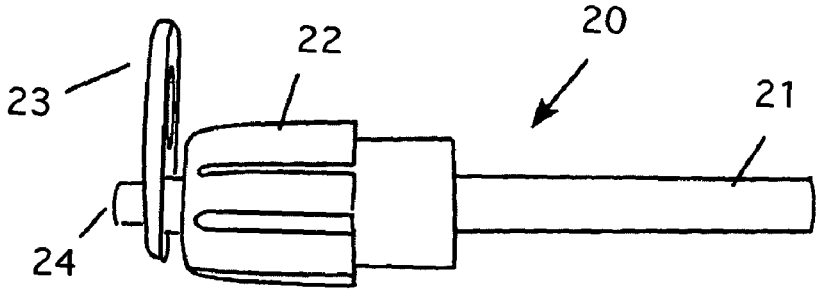
FIG. 5 is a side detail view of one of the handgrip inserts.

FIG. 5 is a side detail view of one of the handgrip inserts. Here, the insert 20 is shown removed from the handgrip. The insert has a long pin 21 that passes through a long housing 22. An eye 23 is secured to the end of the pin 21 by a fastener 24 (see FIG. 6).

Figure 6:
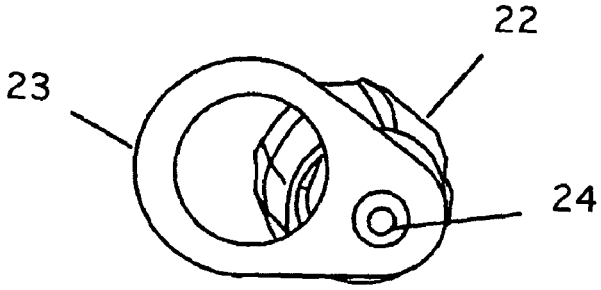
FIG. 6 is an end detail view of one of the handgrip inserts.

FIG. 6 is an end detail view of one of the handgrip inserts. Here, the eye 23 and fastener 24 are shown at the end of the pin 21.

Figure 7:
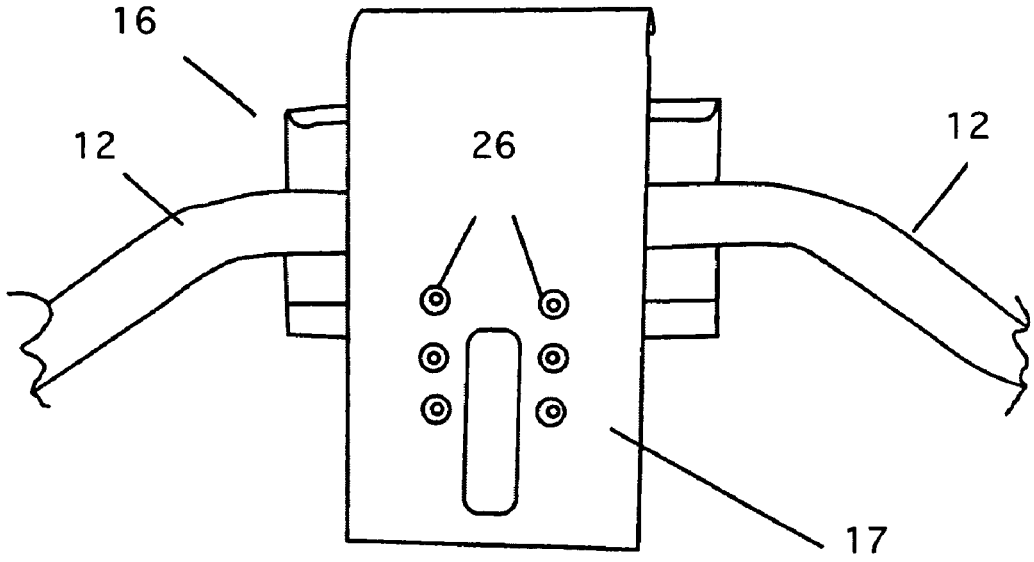
FIG. 7 is a detail view of the bottom sliding hook member.

FIG. 7 is a detail view of the bottom sliding hook member 17. In this view, the sliding hook 17 is shown. The sliding hook has six fasteners 26 that secure two brackets (discussed below) to the other side of the hook, which then engage the slots in the pivot hub body (as discussed below).

Figure 8:
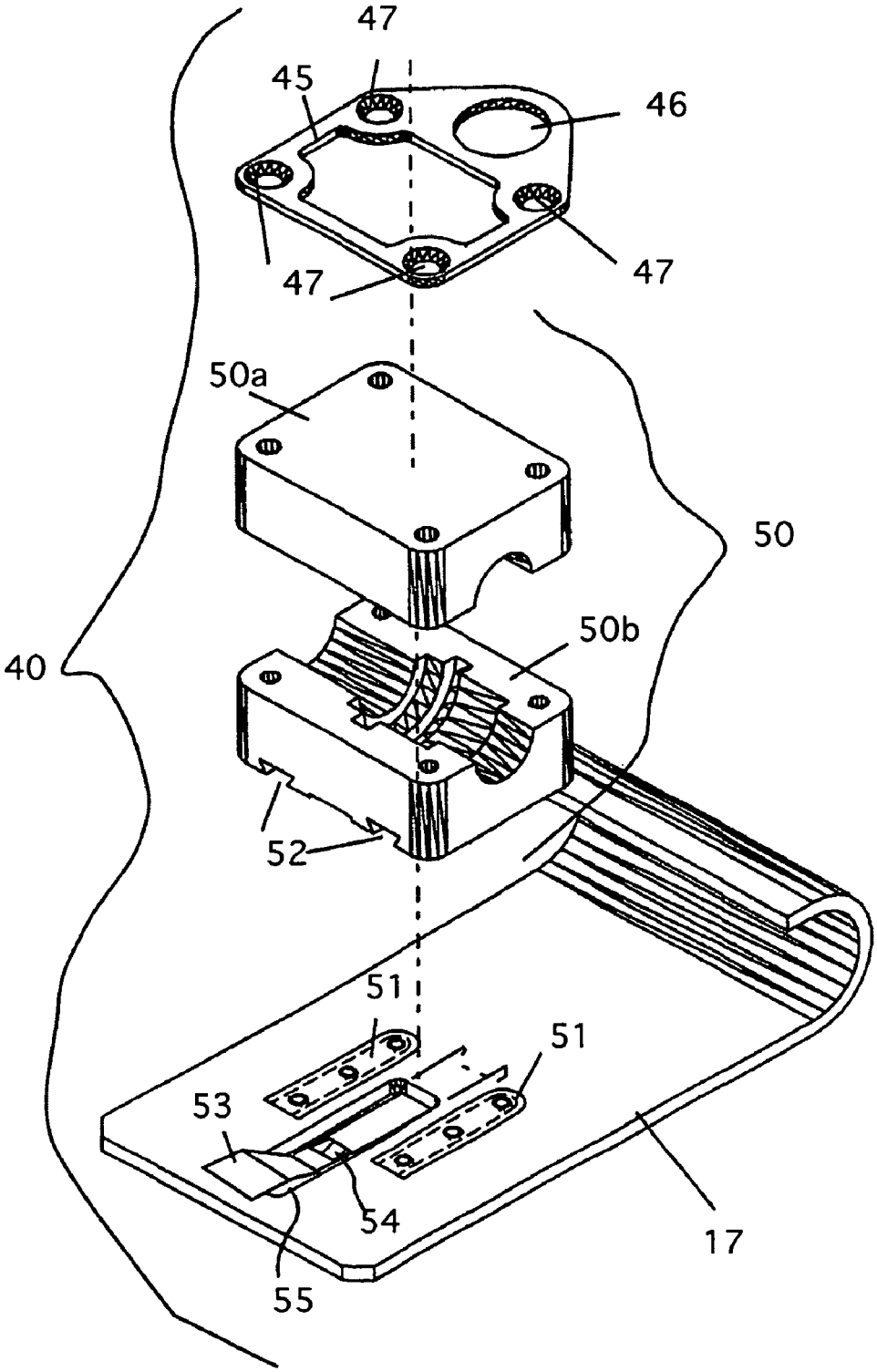
FIG. 8 is an exploded view of the main components of the pivot hub.
Figure 9:
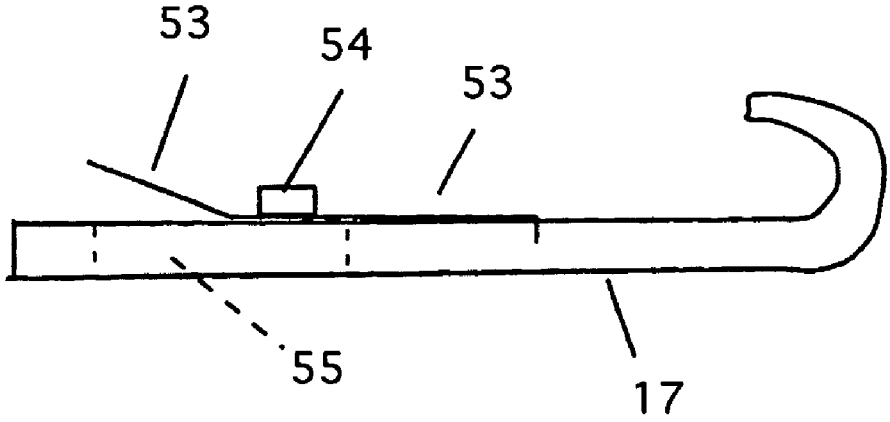
FIG. 9 is a side view of the hook showing the lock and release mechanism.

FIG. 8 is an exploded view of the main components of the pivot hub 40. The pivot hub has several components that are attached to form the module. At the top is an eye plate 45 that has an eye 46 and holes 47 for fasteners (not shown). The center body 50 has an upper portion 50*a* and a lower portion 50*b*. The upper block 50*a* has holes to accept fasteners that secure the eye plate and lower portion together. The handle bar and rotating mechanism (discussed below) are positioned inside the center body. The top of the hook 17 is shown with the brackets 51 that are attached to the top of the hook 17. The brackets 51 engage the dovetail slots 52 that are formed in the bottom portion 50*b* of the center body. In this way, the hook can be pulled out or in as desired. To lock the hook into place, a spring clip 53, made of spring steel, and block 54 are used. The spring clip 53 is secured in place over a slot 55 that is formed in the hook 17. As the brackets slide in the dovetails 52 of the pivot block, the block 54 fits into a channel on the pivot block. This locks the hook in the extended position. To retract the hook, the user presses on the spring clip (through the slot 55), which causes the block to drop down so that the hook can be pushed back into the retracted position. FIG. 9 shows a side view of the hook 17 showing the relationship of the spring clip 53 and the block 54.

Figure 10:
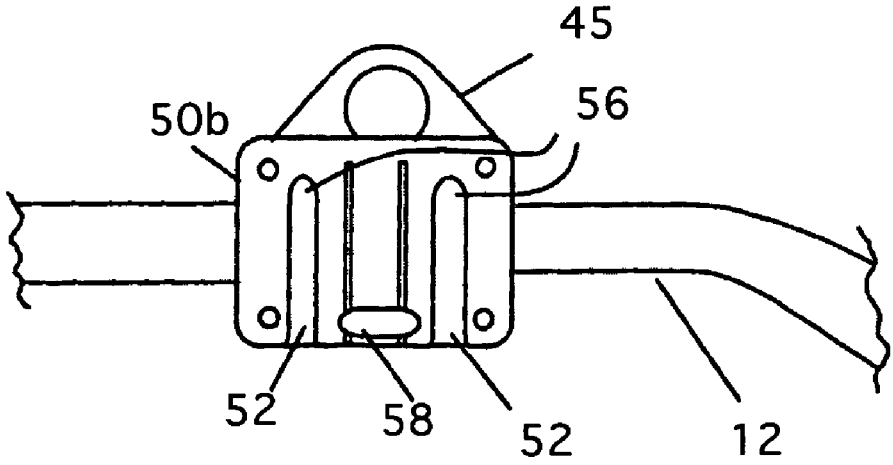
FIG. 10 is a bottom detail view of the pivot hub on a handlebar.

FIG. 10 is a bottom detail view of the center body on a handlebar. The handlebar 12, as noted above, is positioned between the top portion of the center body and the lower portion 50*b* of the pivot hub. In this view, the dovetail slots 52 are shown. The slots have a stop 56 at the back of the slots to prevent the hook from sliding through the pivot hub.

Figure 11:
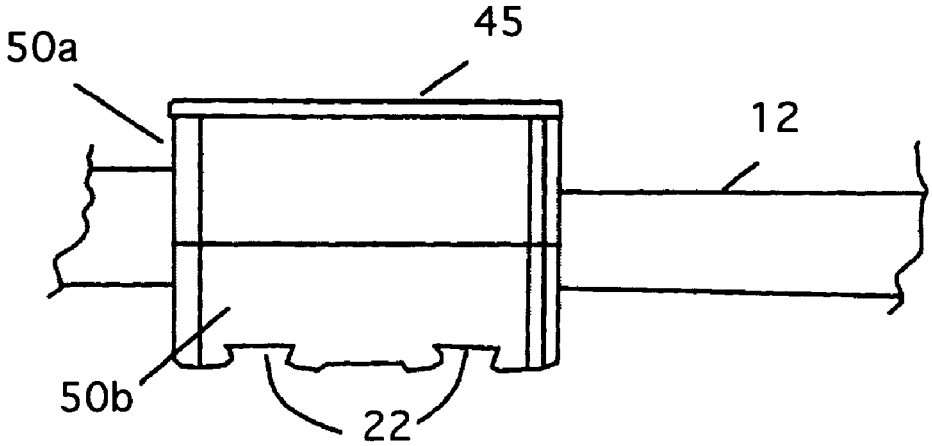
FIG. 11 is a side detail view of the pivot hub on a handlebar.

FIG. 11 is a side detail view of the pivot hub on a handlebar. Here, the top portion 50*a* and the bottom portion 50*b*, with dovetails 52, are shown with the eye plate 45 in place around the handlebar 12.

Figure 12:
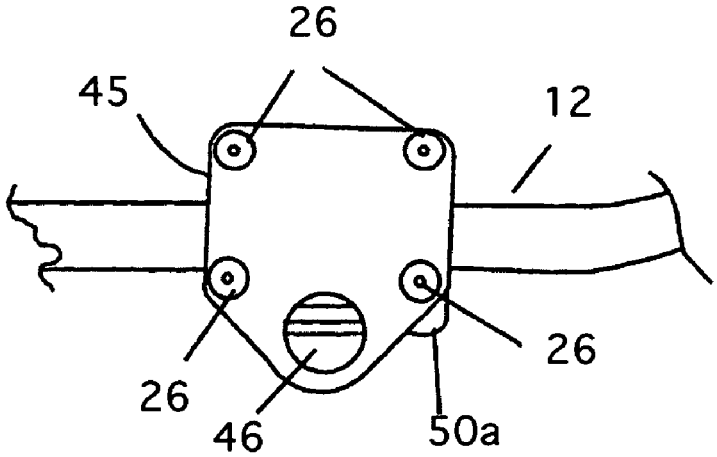
FIG. 12 is a top detail view of the pivot hub on a handlebar.

FIG. 12 is a top detail view of the pivot hub on a handlebar. Here, the eye plate 45 is shown secured to the center body with fasteners 26

As noted above, the second embodiment has a handlebar that can rotate from a first position to a second position. This is accomplished by a spring system installed in the pivot hub. The spring system is considered to be a means for causing said pivot hub to move from said first operating position to said second operating position and from said second operating position to said first operating position.

In the preferred embodiment, the pivot body is replaced with a clamp that secures the eye 3 to the handlebar in a fixed position.

Figure 13:
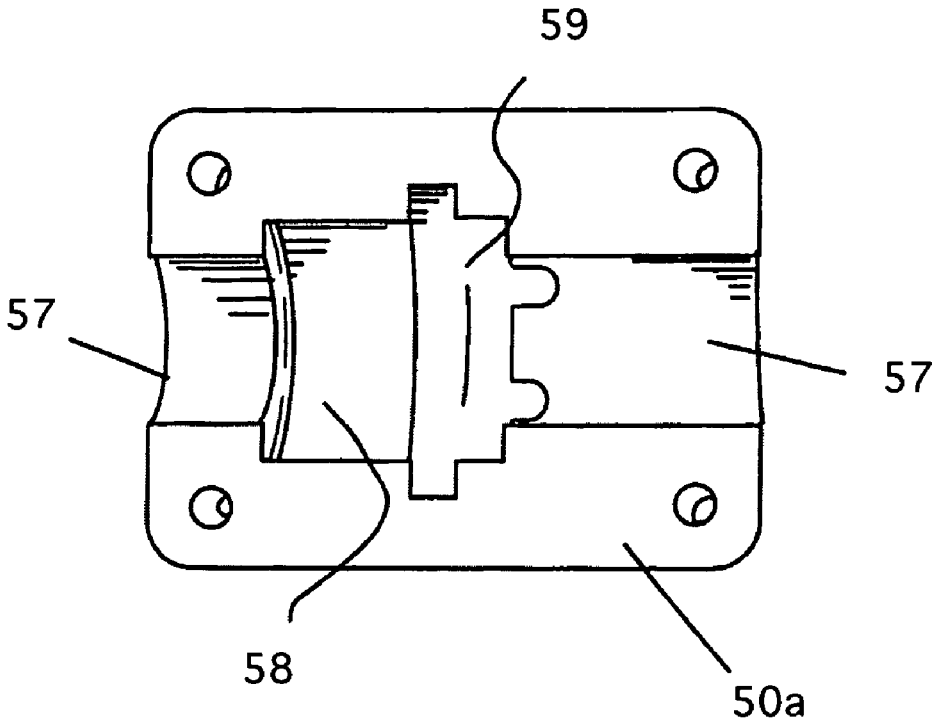
FIG. 13 is a detail view of the inside of the pivot hub body.

FIG. 13 is a detail view of the inside of the top portion 50*a* of center body 50. This portion has a cylindrical form 57 machined into it to receive the handlebar (not shown). In the center of the piece is a deeper cut 58 that holds a spring (see, e.g., FIG. 14). There is a curved slot 59 also machined that received the pin that holds tension on the spring. This mechanism acts as a means for locking the pivot hub in a first operating position and a means for locking the pivot hub in a second operating position.

Figure 14:
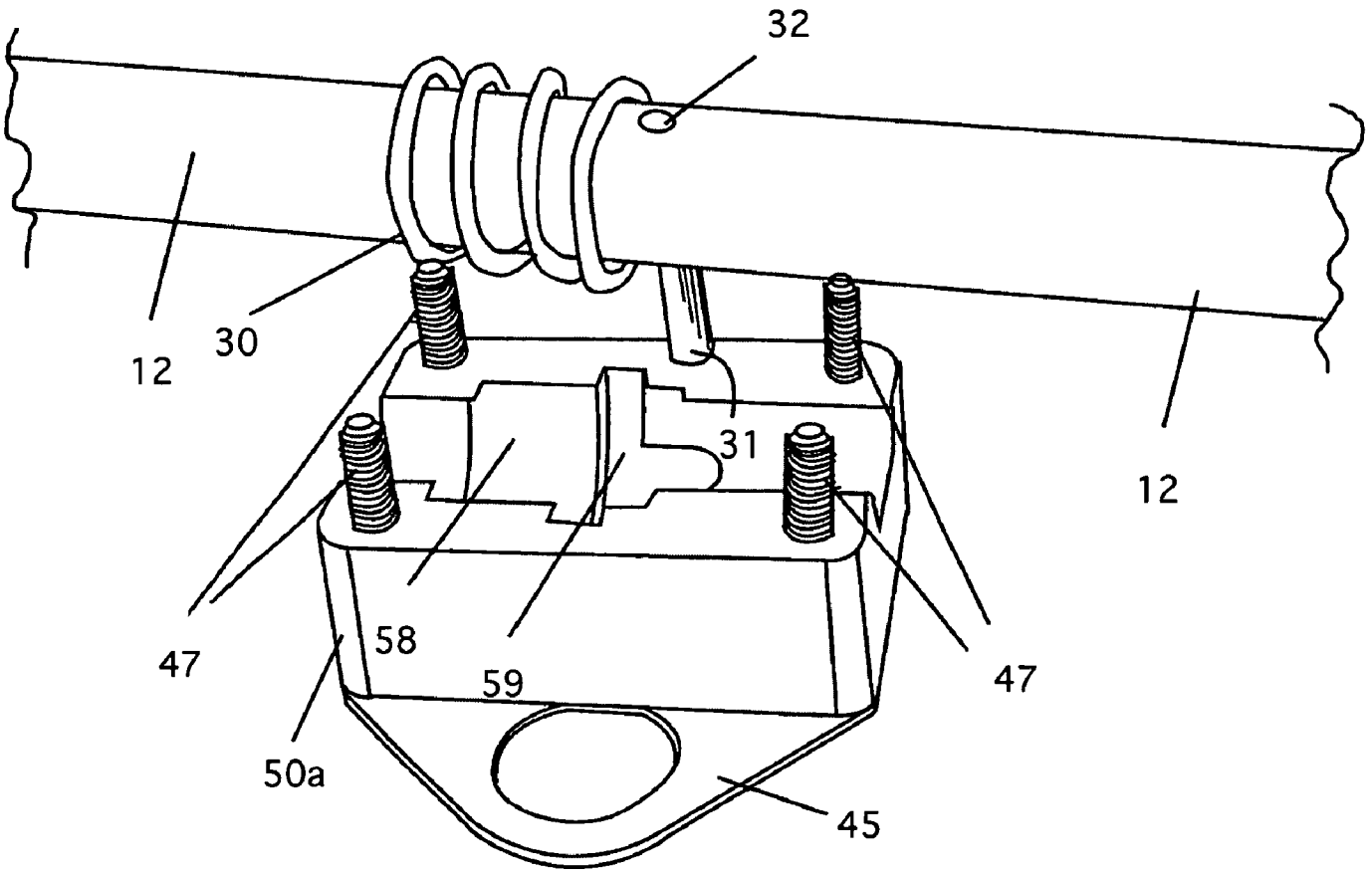
FIG. 14 is a detail view of the pivot hub body showing a handlebar with a spring and pin prior to installation in the pivot hub body.

FIG. 14 is a detail view of the pivot hub body showing a handlebar 12 with a spring 30 and pin 31 prior to installation in the pivot hub body. In this view, the top of the pivot body 50*a* is shown. Note that the handle bar 12 has a hole 32 into which the pin 31 sits. When installed the pin extends above the edge of the hole to restrain the spring 30. Note the recess 58 that holds the spring when the unit is assembled. The slot 59 holds the pin 32 and provides a track for it to follow as the handlebar is turned. Note also the fasteners 47 extending from the top portion of the center body.

Figure 15:
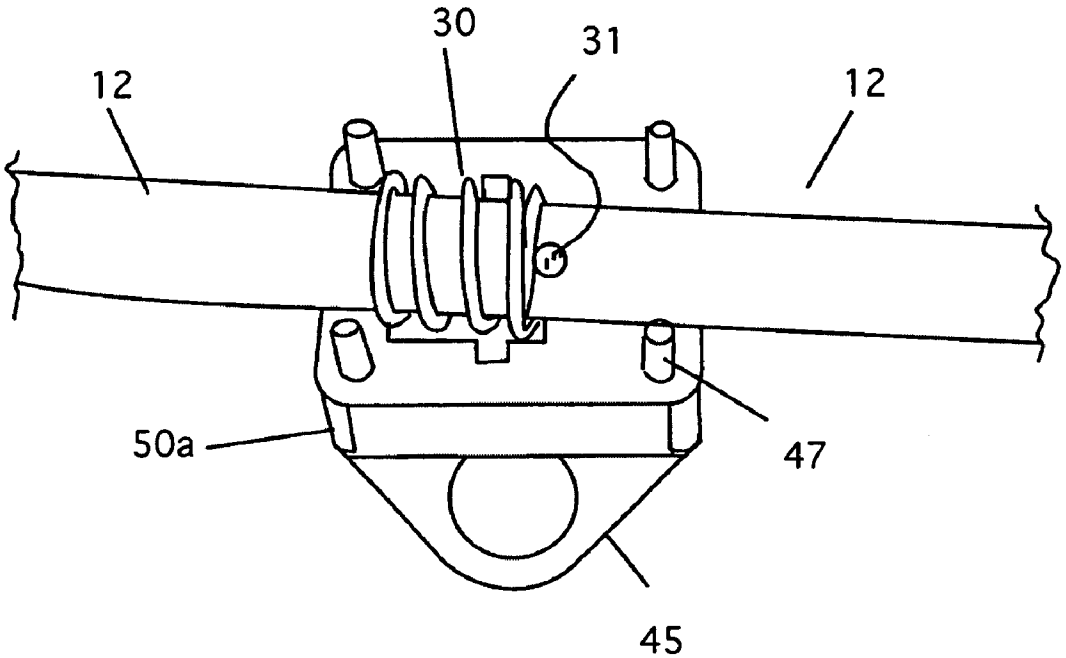
FIG. 15 is a detail view of the handlebar, spring and pin assembly installed in the pivot hub body.

FIG. 15 shows the spring and pin installed in the pivot hub body. Here, the spring 30 is positioned in the recess 58 Note that the pin 32 rests against the side of the spring as shown. To complete the installation, the bottom portion 50*b* is installed and the fasteners are then tightened. The complete installation is shown in FIGS. 10-12.

Figure 16:
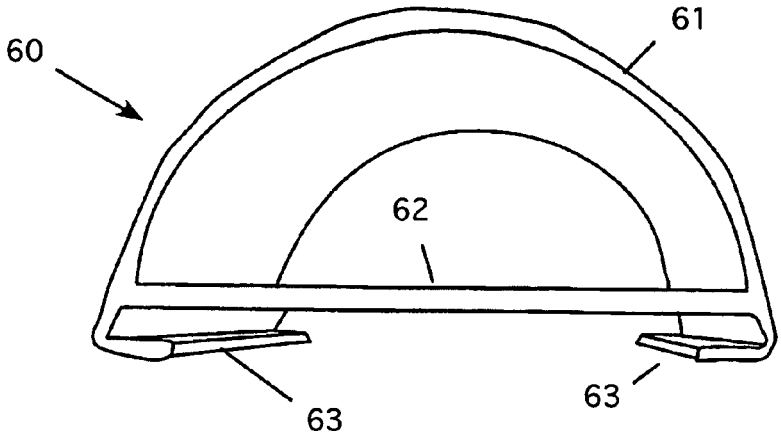
FIG. 16 is a front view of a rocker member that is attached to the hook for additional exercise variety.
Figure 17:
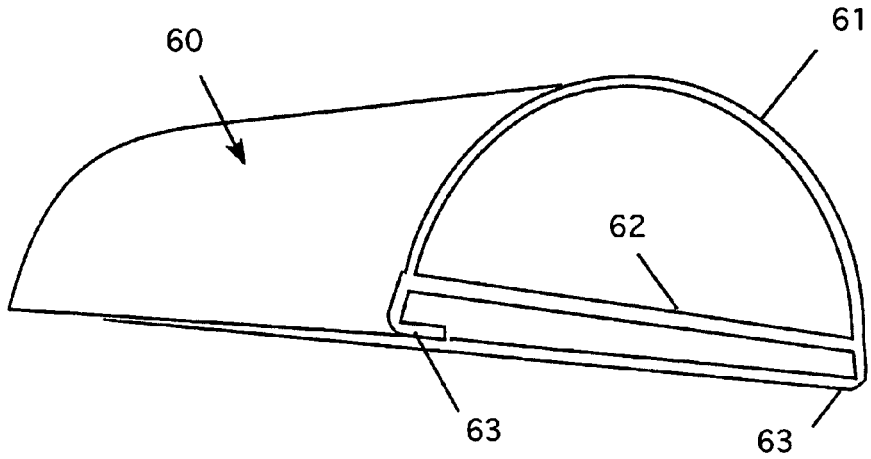
FIG. 17 is a perspective view of the rocker member.

FIG. 16 shows a rocker member 60 that is attached to the skid plate for additional exercise variety. The rocker member 60 is a significant advance over my previous design. FIG. 17 is perspective view of the rocker member 60. The rocker member 60 has a curved top section 61, a bottom plate 62 that forms a floor for the curved top and to angled slide members 63 that are below the bottom member and run the length of the rocker member. The side members 63 are used to secure the rocker member to the skid plate, as discussed below.

Figure 18:
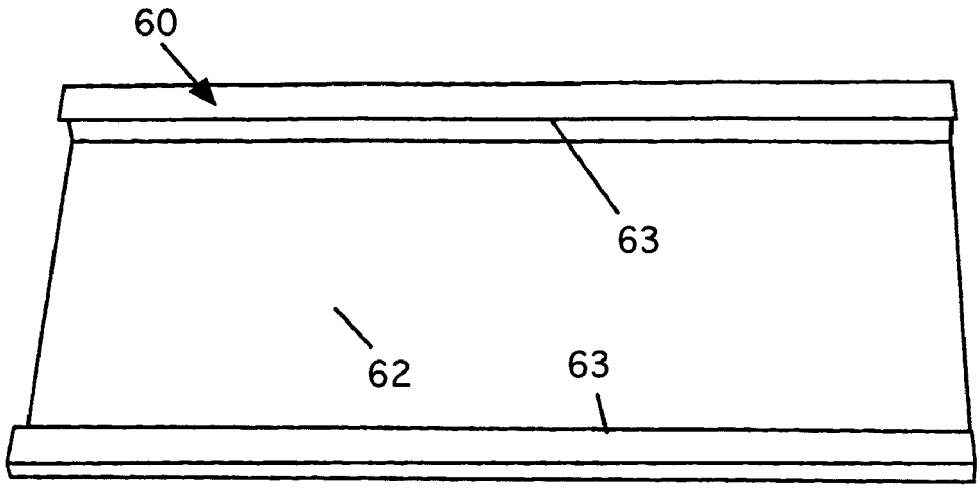
FIG. 18 is a bottom view of the of the rocker member.
Figure 19:
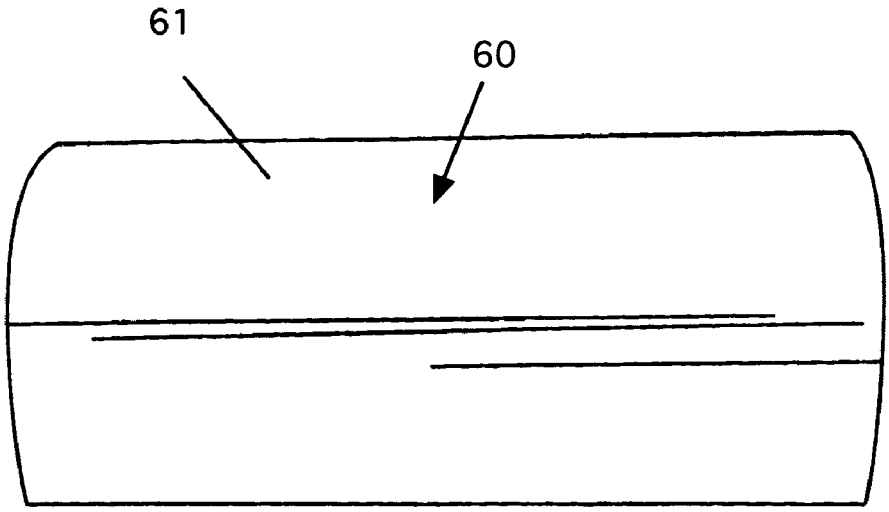
FIG. 19 is a top view of the of the rocker member.

FIG. 18 is a bottom view of the rocker member 60; here, the bottom plate 62 and slide members 63 are shown. FIG. 19 is a top view of the of the rocker member. The view shows the curved upper section 61.

Figure 20:
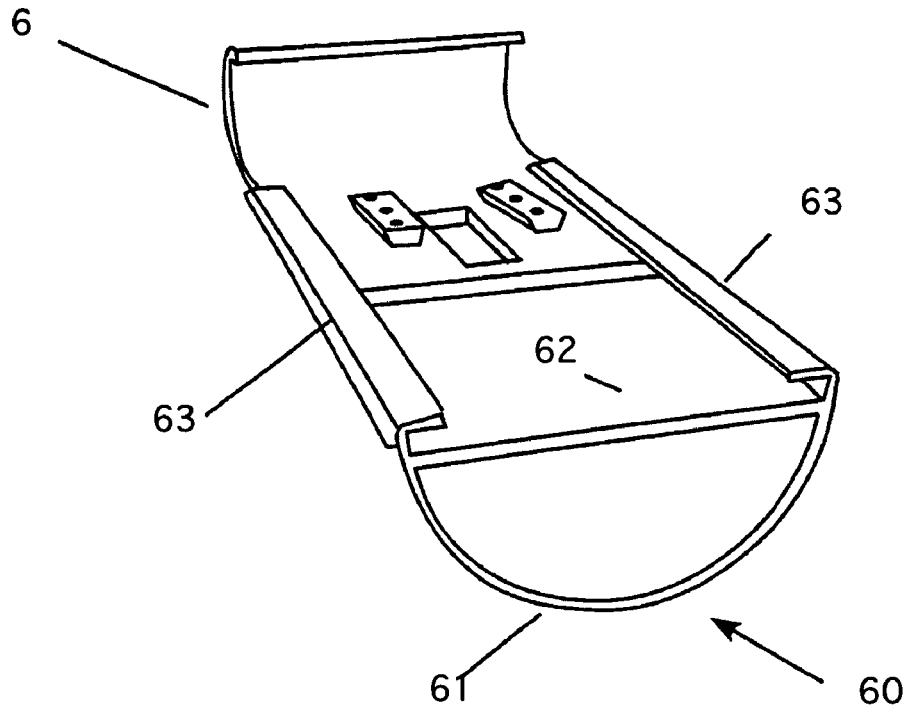
FIG. 20 is a detail view of the rocker member installed on the hook.

FIG. 20 is a detail view of the rocker member 60 installed on the skid plate 6. Note that the pivot hub and handlebar are not shown for clarity, but in use, the skid plate 6 is attached to the handlebar as discussed above. The rocker body 60 is placed upside down on the skid plate 6 as shown. The slide members 63 grip the sides of the skid plate to hold the member in place.

In the case of the second embodiment, the rocker member 60 is attached to the hook 17 in the same manner.

For the handlebar of the second embodiment, when the handlebar is in a first position the skid plate sits parallel to the plane of the handlebars. In the second position, the pivot hub is rotated down 90 degrees so that the skid plate is perpendicular to the plane of the handlebars 12. To switch positions, the user simple pushes the center body cover 16, which causes the spring 30 in the pivot body under the cover to compress, while holding the handlebars 12. Then the user rotates the center body cover to the first or second position, while the spring is compressed. When the switch has been completed, then the user releases the center body, which causes the spring to expand and prevent further movement. The process is reversed to return the handlebars to the other position.

In the case of the preferred embodiment, there is no ability for it to pivot. The user simply attaches the device to a particular pieces of exercise equipment to be used as an exercise bar, or uses the device on the floor, with or without the rocker member, for push ups and other exercises. The rocker member is positioned so that when the unit is on the floor the user can rock from side to side while griping the handlebars. This enables rocking style push-ups as well as other exercises that take advantage of the rocking action.

Figure 21:
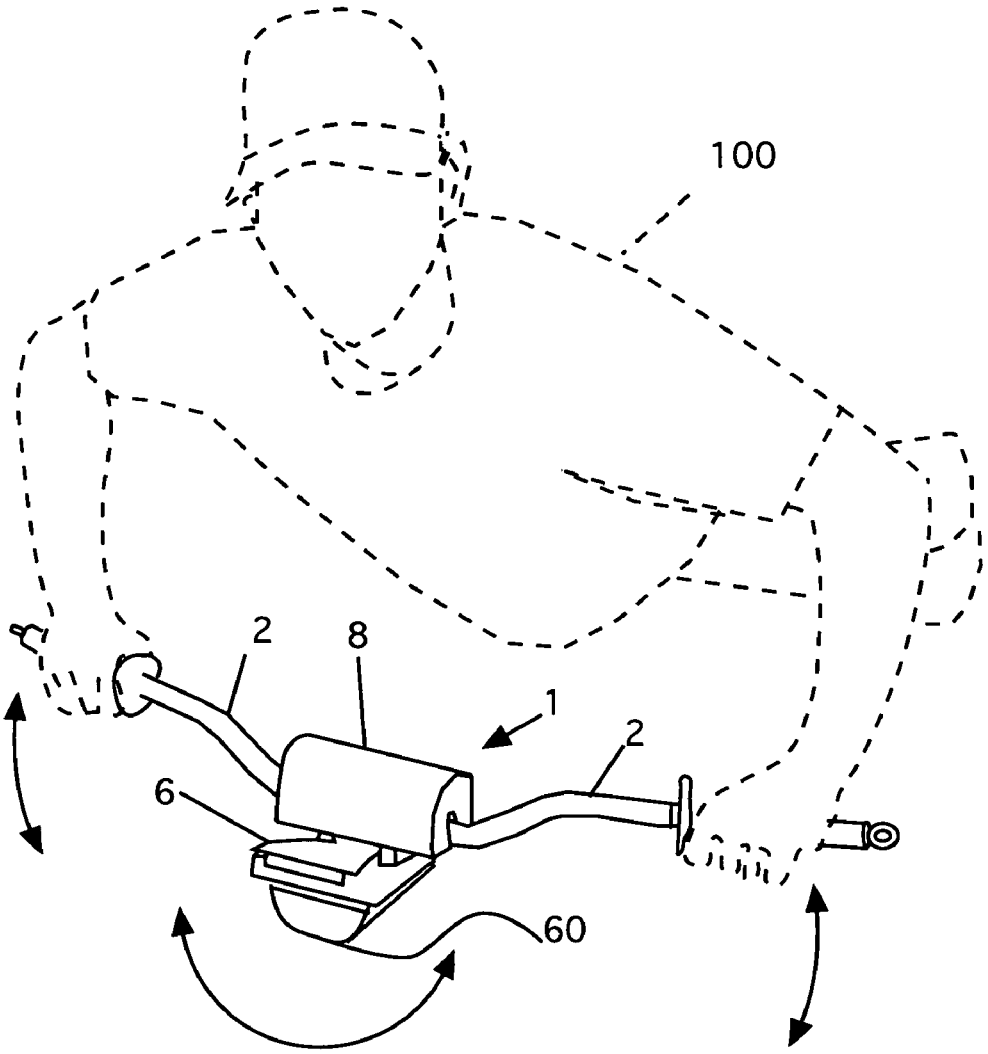
FIG. 21 is a detail view of a user using the preferred embodiment in an actual floor exercise.

FIG. 21 is a detail view of a user using the preferred embodiment in an actual floor exercise. In this view, a user 100 is doing push ups with the device 1. The rocker member 60 is in place. The handlebar 2 is being gripped by the user as shown. The arrows indicate the movement of the device during the workout. As the user pushes one side of the bar 2 down, the other side is pushed up, and vice versa. This action is accommodated by the rocker member 60. The arrow at the base of the rocker member indicates that the rocker member rocks back and forth as the user 100 operates the device.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. An improved exercise bar comprising:

a) a handlebar having a center portion, and two side angled portions extending upward and outward from said center portion;

b) two horizontal grip members, attached to said handlebar;

c) a skid plate attached to the center portion of said handlebar;

d) a rocker member, having a curved bottom portion, removably attached to said skid plate and extending downwardly therefrom; and e) an eye, attached to said center portion of said handlebar.

2. The exercise bar of claim 1 wherein the skid plate is slidably attached to said handlebar.

3. The exercise bar of claim 1 further comprising an eye, attached to each of said two horizontal grip members, wherein each eye extends outwardly from said horizontal grip member.

* * * * *